United States Patent [19]

Halladay, Jr.

[11] Patent Number: 4,850,618

[45] Date of Patent: Jul. 25, 1989

[54] LOTTERY TICKET

[75] Inventor: Allan W. Halladay, Jr., Bristol, R.I.

[73] Assignee: Halladay Incorporated, Providence, R.I.

[21] Appl. No.: 142,062

[22] Filed: Jan. 11, 1988

Related U.S. Application Data

[63] Continuation of Ser. No. 862,663, May 13, 1986, abandoned.

[51] Int. Cl.[4] ..... B42D 15/00

[52] U.S. Cl. ..... 283/94; 283/102; 283/903

[58] Field of Search ..... 283/94, 70, 72, 74, 283/95, 97, 98, 99, 100, 101, 102, 903

[56] References Cited

U.S. PATENT DOCUMENTS

| | | | |
|---|---|---|---|
| 3,789,425 | 1/1974 | Matsushima | 346/135 |
| 3,861,952 | 1/1975 | Tokumoto et al. | 117/217 |
| 3,945,870 | 3/1976 | Johnsen | 283/903 |
| 4,095,824 | 6/1978 | Bachman | 283/903 |
| 4,174,857 | 11/1979 | Koza | 283/101 |
| 4,191,376 | 3/1980 | Goldman et al. | 283/903 |
| 4,241,942 | 12/1980 | Bachman | 283/903 |
| 4,299,637 | 11/1981 | Oberdeck et al. | 283/903 |
| 4,305,082 | 12/1981 | Kusakawa et al. | 346/135.1 |
| 4,398,708 | 8/1983 | Goldman et al. | 283/903 |
| 4,460,676 | 7/1984 | Fabel | 430/333 |
| 4,486,033 | 12/1984 | Parrotta | 283/94 |
| 4,560,426 | 12/1985 | Moraw et al. | 283/75 |
| 4,597,592 | 7/1986 | Maurer et al. | 283/75 |
| 4,643,454 | 2/1988 | Ondis | 283/74 |
| 4,677,553 | 6/1987 | Roberts et al. | 283/100 X |

FOREIGN PATENT DOCUMENTS

| | | |
|---|---|---|
| 1275929 | 7/1969 | United Kingdom . |

*Primary Examiner*—Paul A. Bell

[57] ABSTRACT

A lottery ticket which has a layer of thermally-activated material beneath a ruboff layer, the material being selectively activated by a thermal sensor at the point of sale so as to apply the prize indicia on the thermally-activated material while it is still underneath the ruboff layer.

14 Claims, 1 Drawing Sheet

LOTTERY TICKET

This application is a continuation of U.S. patent application Ser. No. 862,663, filed May 13, 1986, now abandoned.

FIELD OF THE INVENTION

This invention relates to lottery tickets and in particular to the fabrication of them and to a method of adding prize indicia to them.

BACKGROUND OF THE INVENTION

A large number of legal lotteries exist today, and many are of an instant variety, that is, the purchaser of a ticket can learn immediately whether or not he or she has won a prize. The most common of these instant lotteries involve the sale of individual lottery tickets which have prize information printed beneath some opaque ink that is rubbed off by the purchaser to determine whether or not a prize has been won. The prize information (or lottery number) is printed on those tickets and covered with an opaque ruboff layer and a "confusion" pattern. The latter prevents the prize information from being read without scratching off the ruboff layer. The prize information, the opaque layer and the confusion pattern are all added to the ticket during the manufacturing process.

The fact that the prize information is printed on the ticket at the time of its manufacture creates some problems. First, printing the prize information on each ticket as it is manufactured makes the manufacture of the tickets a very involved and expensive process (as the prize indicia must change with almost every ticket). Secondly, and more importantly, if the tickets are stolen prior to sale, they already contain the prize information, and any winning tickets could be wrongfully redeemed.

SUMMARY OF THE INVENTION

I have discovered a method of making instant lottery tickets having a series of layers, one of which comprises a thin sheet of thermally-activated material which is covered at least in part by an opaque ruboff layer. The ticket contains no prize indicia when it is manufactured. Instead, the prize information is added by applying heat through the opaque layer to the thermal material by means of a thermal sensor at the point of sale, which sensor is connected to the lottery computer.

In a preferred embodiment, card stock which comprises a layer of aluminum foil laminated to cardboard is coated with an acrylic to improve its ink and laminating adhesion properties. Thermal paper is then permanently bonded to a portion of the coated card stock. A clear release coat is applied to the thermal paper, and graphics are added to the front and back of the ticket. A soft layer and a hard layer of ruboff ink are then applied in sequence over the release coat on the thermal paper. A confusion pattern is then added over the ruboff ink layers, and a clear coating is then applied over the thermal paper side of the entire card. In use, a thermal sensor can create numbers or letters in the thermal paper without disturbing the ruboff inks of the confusion pattern, and this is done at a point of sale terminal connected to the lottery computer, which instructs the sensor as to what indicia to apply.

DESCRIPTION OF THE PREFERRED EMBODIMENT

We now turn to a description of the preferred embodiment, after first briefly describing the drawings.

Drawings

Structure

Figure 1:
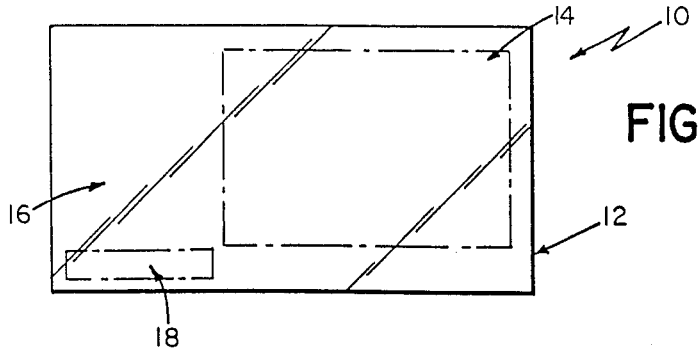
FIG. 1 is a top view of a lottery ticket of the invention.

Referring to FIG. 1, a lottery ticket according to the invention is shown at 10. The ticket 10 generally comprises a card 12 with a prize area 14 and a graphics area 16. The ticket may also include a serial number 18. The prize area 14, the graphics area 16 and the serial number 18 can be placed on the card 12 in any arrangement that is desired.

Figure 2:
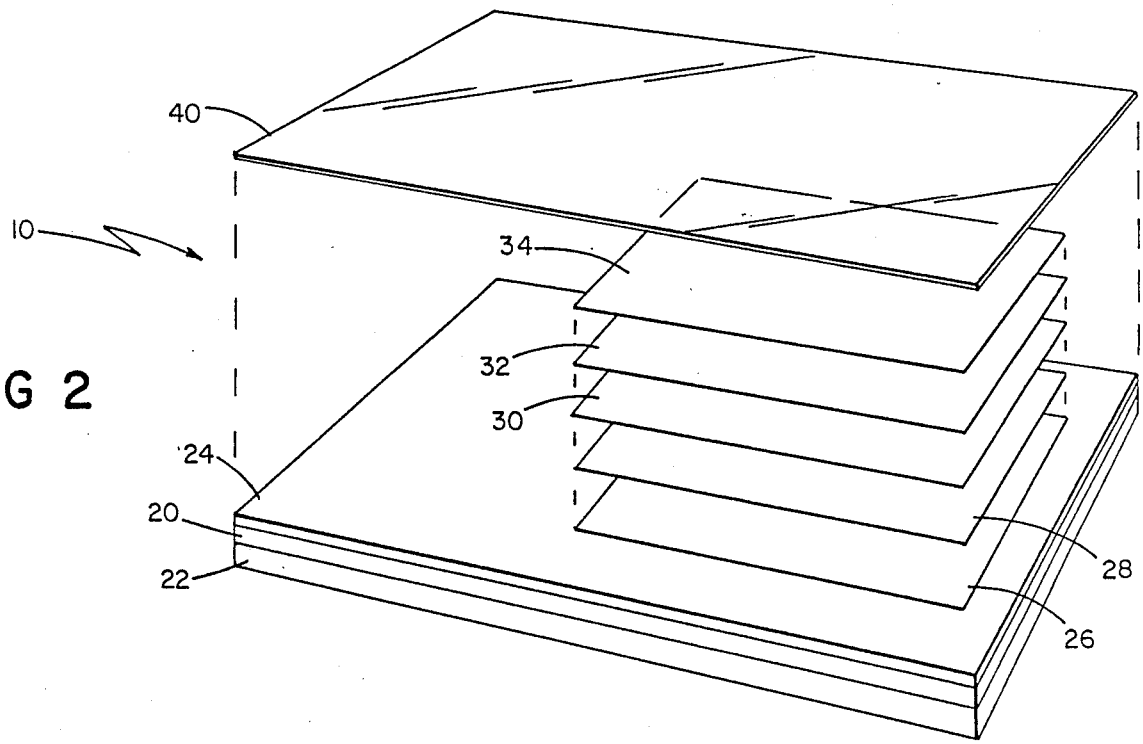
FIG. 2 is an exploded view of the lottery ticket of FIG. 1, showing its various layers.
Figure 3:
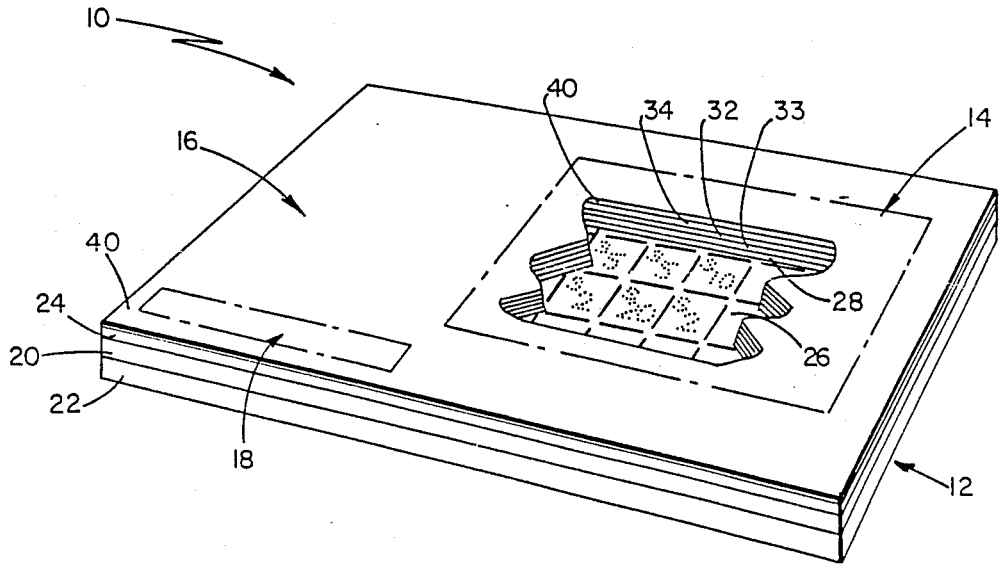
FIG. 3 is a lottery ticket of this invention with its thermally-activated layer and prize indicia partially revealed.

Referring to FIG. 2, the lottery ticket 10 of this invention is made in a number of steps. First, a thin aluminum foil layer 20 is permanently laminated to the top of a piece of cardboard card stock 22 having a thickness of between 0.080 and 0.010 inches. The lamination is done by any of the usual methods known in the art for this purpose. The foil layer 20 may be laminated to either side of the card stock 22, as its purpose is to prevent the prize information from being read through the ticket. However, in the preferred embodiment, as with most instant lottery tickets, the foil is applied to the top of the cardboard. When the foil layer 20 is on top of the card, as in the preferred embodiment, the foil layer 20 is then itself laminated with an acrylic or other coating 24 to maximize its ink and laminating adhesion properties, as shown in FIG. 3.

A thin layer of thermally-impregnated paper 26 is then laminated to the portion of the aluminum foil layer 20 covering the prize area 14 of the card 10. A permanent adhesive is used. Thermal paper 26 is sensitive to heat. A suitable thermal paper, which activates between 120° F. and 150° F., is available from RICOH Electronics, Inc. of Santa Ana, Calif. However, in the alternative, a thermal solution could be applied to the prize area 14 instead of a thermal paper 26.

The next step is to apply a clear release coat 28 over the thermal paper 26 by means of a flexographic printing process. A suitable coating is SSX-1637, which is available from Louis 0. Wernecke Ink Co. of St. Louis Park, Minn.

Next, descriptive graphics and the serial number for the ticket are printed on the ticket. This printing is for the graphics area 16 and serial number area 18 only. It does not include the prize area 14, which is now covered by the thermal paper and its release coat 28. This printing is done by flexographic or by a photo offset process. At the same time, the back of the ticket 10 is printed with various information (e.g., game rules, how to redeem prizes etc.)

A first opaque ruboff layer 30 is then applied over the release coat 28 covering the thermal paper 26. The first ruboff layer 30 is a soft ruboff layer, which scratches off fairly easily. It has a melting point of above 350° F. A second opaque ruboff layer 32 is then applied over the first 30. Second layer 32 is a harder ruboff layer, and it is designed to prevent any accidental wearing away of the layers due to physical wear. It is also used to protect the ticket during thermal activation, which is described below. The second ruboff layer 32 also has a melting point above 350° F. Suitable ruboff inks are available from the Louis O. Wernecke Ink Co. The first layer 30 may be SSK-1629, while the second layer 32 may be SSK-1635.

The next step is to apply a conventional confusion pattern 34 over the ruboff layers to obscure the prize indicia which will be subsequently generated on thermal paper 26. Louis O. Wernecke Ink Co. provides a suitable ink identified as SSKP-9.

Finally, a clear protective coating 40 is applied to the entire top surface of the ticket 10. A clear varnish solution may be used. In the alternative, a clear varnish solution with a ultraviolet drying system may be used. Louis O. Wernecke Ink Co. SSOP-561 or SSX-803 are suitable. This coating not only protects the ticket 10 from physical wear but also protects it from any heat damage during thermal activation.

As a final step, the tickets themselves (which are actually made in a long attached strip) are perforated, fan folded or slitted and wound on a roll, depending upon the requirement of the lottery and the point of sale printer being used.

Operation

When the completed lottery tickets 10 have been delivered to the point of sale, they are blank. The thermal layer 26 has no prize indicia whatsoever. Consequently, any theft of the tickets up until that point does not result in the loss of valid prize winning tickets. Instead, each ticket 10 has its prize information added only when it is actually sold to a customer. Each sale location has a thermal head dispenser (not shown), which in the preferred embodiment may be an Astro-Graph AG 200-752 from Astro-Med, Inc. of West Warwick, R.I. The dispenser is connected to the lottery computer. When a ticket is sold, the ticket is sent through a thermal sensor in the dispenser, a portion of which sensor is activated to approximately 150° F. to 200° F. The portions of the sensor which are activated are controlled by the central lottery computer. They apply the different prize information to the ticket as the heat they generate activates the thermal paper underneath the layers (on which paper letters or numbers will then appear, depending upon the heating pattern caused the the sensors). Thus, once sold, the ticket will have its prize information on it, which is revealed by scratching off the ruboff and confusion layers as in the usual case. The unsold tickets, however, remain blank.

Other embodiments will occur to those skilled in the art.

What I claim is:

1. A lottery ticket comprising:

a card stock having top surface and a bottom surface, a metallic layer disposed on one of said surfaces of said card stock, a lamination layer covering said metallic layer when said metallic layer is applied to said top surface, a layer of thermally-activated material for holding prize indicia attached to a portion of said top surface of said card stock or said lamination layer if said metallic layer is disposed on said top surface of said card stock, said thermally-activated layer having no prize indicia thereon when said card is made but to which prize indicia can be applied through the selective application of heat to said card when finished, a release coat which covers said thermally-activated layer, a ruboff material covering at least a portion of said thermally-activated material and said release coat covering it, said ruboff material comprising a first ruboff layer which is applied over at least a portion of said thermally-activated layer and said release coat and a second ruboff layer which is harder than said first ruboff layer and which is applied over said first ruboff layer, a confusion pattern covering at least a portion of said ruboff material, and a protective coating covering said confusion pattern.

2. The lottery ticket of claim 2 wherein said metallic layer comprises a piece of thin aluminum foil.

3. The lottery ticket of claim 1 wherein said thermally-activated layer comprises a thermal paper.

4. The lottery ticket of claim 1 wherein said thermally-activated layer comprises a thermal solution.

5. The lottery ticket of claim 1 wherein said thermally-activated layer activates at temperatures between 120° F. and 150° F.

6. The lottery ticket of claim 1 wherein said ruboff layers have melting temperatures above 350° F.

7. The lottery ticket of claim 1 wherein said lamination layer comprises an acrylic coating.

8. The lottery ticket of claim 1 wherein said release coat between said thermally-activated layer and said ruboff material is clear.

9. The lottery ticket of claim 1 wherein said protective coating is a clear varnish solution with a melting point above 350° F.

10. The lottery ticket of claim 1 wherein said protective coating is a clear varnish solution with an ultraviolet drying system.

11. A method of making a lottery ticket comprising:

applying a metallic layer to either a top or bottom surface of a card stock, laminating said metallic layer with a laminate when said metallic layer is applied to said top surface of said card stock, attaching a layer of thermally-activated material to card stock or said laminate if said metallic layer is applied to said top surface of said card stock, said thermally-activated layer having no prize indicia thereon but to which prize indicia may be applied through the selective application of heat to said finished card, applying a release coat over said thermally-activated layer, applying a ruboff material over at least a portion of said thermally-activated material and said release coat covering it, said applying a ruboff material comprising applying a first layer of ruboff ink and then applying a second layer of a different ruboff ink which is harder to scratch off than said first layer of ruboff ink, applying a confusion pattern over at least a portion of said ruboff material, and applying a protective coating over said confusion pattern.

12. The method of claim 11 wherein attaching a thermally-activated layer comprises laminating thermal paper to the card stock or said laminate.

13. The method of claim 11 wherein said ruboff layers are applied by flexographic printing.

14. The method of claim 11 wherein said laminating comprises applying an acrylic coating over said card stock.

* * * * *